211-69.5 SR
10/22/85 OR 4,548,325

United States Patent [19]
Hojer et al.

[11] Patent Number: 4,548,325
[45] Date of Patent: Oct. 22, 1985

[54] TECHNICAL PEN HOLDER

[75] Inventors: Anke Hojer, Hamburg; Jurgen Bockmann, Tangstedt-Rade; Harald Hofmann, Hartenholm; Axel Mikuteit; Hans-Joachim Ritter, both of Hamburg; Rolf Tenhagen, Henstedt-Ulzburg, all of Fed. Rep. of Germany

[73] Assignee: Koh-I-Noor Rapidograph, Inc., Bloomsbury, N.J.

[21] Appl. No.: 586,126

[22] Filed: Mar. 5, 1984

[30] Foreign Application Priority Data

Mar. 5, 1983 [DE] Fed. Rep. of Germany ... 8306378[U]

[51] Int. Cl.[4] ..... B43K 23/00
[52] U.S. Cl. ..... 211/69.5; 401/254
[58] Field of Search ..... 211/69.5, 69.6, 69.2, 211/69.1; 401/194, 258, 243

[56] References Cited

U.S. PATENT DOCUMENTS

| | | | |
|---|---|---|---|
| 2,241,852 | 5/1941 | Guenther | 211/69.5 |
| 2,354,118 | 7/1944 | Hansen | 120/1 |
| 2,511,735 | 6/1950 | Patterson | 120/108 |
| 2,650,570 | 9/1953 | Voelcker | 120/108 |
| 3,428,380 | 2/1969 | Danjczek | 211/69.5 X |
| 3,802,788 | 7/1972 | Danjczek | 401/194 |
| 4,231,669 | 11/1980 | Rosbiegalle et al. | 401/258 |
| 4,334,622 | 6/1982 | Nutchler | 211/69.5 |
| 4,380,403 | 4/1983 | Endres et al. | 401/243 X |

FOREIGN PATENT DOCUMENTS

| | | | |
|---|---|---|---|
| 6932624 | 8/1969 | Fed. Rep. of Germany . | |
| 6932632 | 8/1969 | Fed. Rep. of Germany | 211/69.5 X |
| 2323779 | 11/1974 | Fed. Rep. of Germany | 211/69.5 |
| 2380895 | 10/1978 | France | 211/69.5 |
| 524648 | 8/1940 | United Kingdom | 211/69.5 |

*Primary Examiner*—Robert W. Gibson, Jr.
*Attorney, Agent, or Firm*—David H. Semmes; Warren E. Olsen

[57] ABSTRACT

A stand for receiving a tubular writing pen which comprises an insertion opening, a sealing element of elastically deformable material disposed below the insertion opening and adapted to come into a sealing engagement contact with the free end of the writing tube of an inserted tubular writing pen. The sealing element (4) has a bearing area for contact with a writing tube (12) that is convex curved in the direction toward said insertion opening of the stand (1, 2) and is deformable away from said insertion opening by contact with the tube. The stand further is characterized by an elastically deformable restraining element (5) which is provided between said sealing element (4) and said insertion opening, and adapted to engage against an inserted tubular writing pen (10, 11, 12).

3 Claims, 4 Drawing Figures

TECHNICAL PEN HOLDER

BACKGROUND OF THE INVENTION

The present invention relates to a holder, or stand, for receiving a technical, or tubular, writing pen, and is characterized by a sealing element of elastically deformable material that comes into sealing engagement with the free end of the writing tube of the pen, when the tubular writing pen is inserted.

In a known stand of this type (disclosed in German Pat. No. G 82 01 625, which corresponds to U.S. Ser. No. 06/459,562), the sealing element comprises a strip of elastic material, which is common to a plurality of tubular holders in one stand. The face of the strip, which is remote from the face that comes into engagement with the writing tube, rests over a relatively large surface area, on a carrier element. If a tubular writing pen is inserted into the tubular holder of the stand, the forward end of its writing tube is accordingly supported on the strip-like material. As a result, the weight of the tubular writing pen somewhat deforms the strip which, therefore, engages in a sealing manner to the forward end of the writing tube.

In this known stand, the forward face of the writing tube comes into engagement with the sealing element solely as a consequence of the weight of the tubular writing pen, so that a satisfactory sealing effect frequently is not attained. Problems may also arise because ink is deposited on the sealing material in the area where the writing tube rests and dries there, so that the forward end of the writing tube may rest on dried ink and, as a result, may not be sealed entirely reliably.

OBJECT AND SUMMARY OF THE INVENTION

It accordingly is an object of the invention to create a stand for receiving a tubular writing pen, in which reliable sealing of the writing tube is attained, and the forward end of the writing tube reliably is prevented from resting on dried ink.

In order to attain this object, a stand of the general type described above is embodied in accordance with the invention such that the sealing element, in the area where the writing tube rests, has a convex curve in the direction toward the insertion opening of the stand and is deformable, in the direction away from the insertion opening. Further, between the sealing element and the insertion opening, there is provided an elastically deformable restraining element which comes into engagement with the inserted tubular writing pen. The sealing element preferably takes the form of an elastically deformable tube segment.

In the stand according to the invention, writing tube bearing area of the sealing element is displaceable. When the writing tube is inserted against the sealing element, the bearing area moves, causing any deposits of dried ink that may be there to flake off. The free end of the writing tube then rests against only the sealing element material and, as a result of the elasticity of this element, sealing is attained.

The restraining element may, for example, comprise a rubber or plastic insert with a central opening. The boundary area of such a rubber or plastic insert forms sealing lips, so a tubular writing pen inserted into the stand is held substantially in the position into which it was placed, by the act of insertion, as its final position. The restraining element, therefore, resists the tubular writing pen being raised by elastic restoring forces from the displaced bearing area of the sealing element, as the bearing area attempts to resume its original position.

The invention will be described in greater detail below, referring to the drawings, which illustrate an exemplary embodiment.

DESCRIPTION OF THE PREFERRED EMBODIMENT

Figure 3:
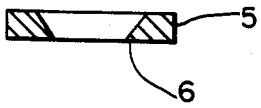
FIG. 3 is a vertical section view, taken through the restraining 5 element.
Figure 4:
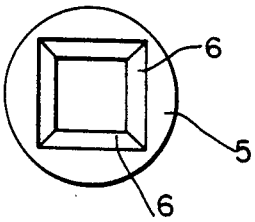
FIG. 4 is a plan view of the restraining element.

The stand shown in the drawings comprises an outer part 1, having an upwardly open insertion opening, and an inner part 2 that is inserted from below into the outer part 1 and held in place by means of a screw 3. An elastically deformable rubber or plastic tube 4 is disposed in the inner part 2, such that its central axis extends at right angles to the direction in which the tubular writing pen is inserted. A circular restraining element 5, of elastic material, is held between the outer part 1 and the inner part 2 and has a square central opening preferably defined by restraining lips 6, which comprise bevel edges. The bevelled restraining lips 6 are formed with an oblique wall surface and as can be seen in FIGS. 1 and 3, the acute angle is on the side of the restraining element 5 that is nearer the sealing element 4.

The tubular writing pen shown is conventional, and comprises a shaft 10, which supports a cylindrical body 11 on its forward end, which in turn supports a writing tube 12. The insertion opening of the outer part, and the bearing areas of the stand located between the insertion opening and the sealing element 4, are configured so that a tubular writing pen can be inserted into the stand with a certain guidance, and ensure that the forward end of the writing tube 12 comes to rest on the tubular sealing element 4 (FIGS. 1 and 2). The oblique, bevelled restraining lips 6 will come to rest on the outer surface of the cylindrical body 11 to hold the tubular writing pen firmly, in a "barb-like" manner, at a final position, after these lips return from an initial, deformed position. The initial, deformed lip position results from the insertion of the tubular writing pen and the vertical return somewhat raises the tubular writing pen into the final position. The restraining lips 6 do not, however, hinder removal of the tubular writing pen from the stand, since the pen preferably is rotated somewhat, about its longitudinal axis, upon being removed.

Figure 1:
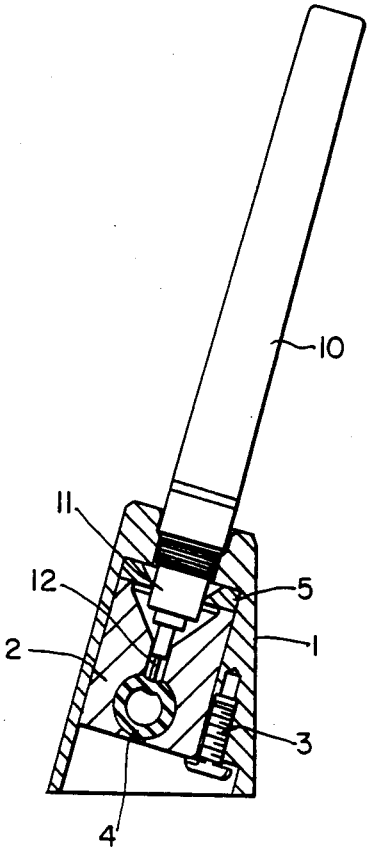
FIG. 1 is a vertical section view, taken through a stand with a tubular writing pen inserted.
Figure 2:
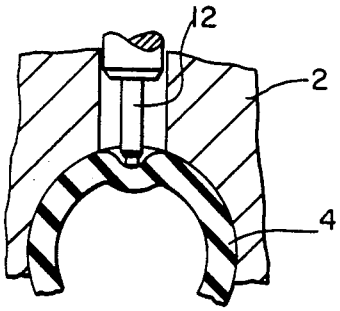
FIG. 2 is a partial vertical section view, showing both the shape of the sealing element and the position of the writing tube, when the tubular writing pen is inserted.

As shown in FIG. 1, a tubular writing pen is inserted into the stand in such a manner that the writing tube 12 displaces the bearing area of the sealing element 4 inward, to some extent. As a result, a good sealing of the writing tube is attained and any dried ink deposits which may be present are loosened. The tubular writing pen thereby is held in a final position by a "barb-like" action, exerted by the restraining lips 6, and assisted by the resilient sealing element.

While a preferred embodiment of our invention has been shown and described, the invention is to be defined by the scope of the appended claims.

We claim:

1. A stand for receiving a tubular writing pen, comprising a stand with an insertion opening and a sealing element of elastically deformable material disposed within said stand and below said insertion opening, said sealing element adapted to come into a sealing engagement contact with the free end of the writing tube when the barrel of the tubular writing pen is inserted, characterized in that the sealing element (4) further comprises a tube segment, with a central axis diposed substantially at a right angle to the direction of pen insertion, said tube segment having a bearing area for contact with a writing tube (12) that normally is convex curved in the direction toward said insertion opening of the stand (1, 2) and is deformable away from said insertion opening by said contact, and further characterized by an elastically deformable restraining element (5) which is provided between said sealing element (4) and said insertion opening, and adapted to engage against the barrel of an inserted tubular writing pen (10, 11, 12), so as to hold said pen in a rest position, with said writing tube substantially, locally deforming a bearing area of said sealing element.

2. A stand according to claim 1, characterized in that said restraining element (5) further comprises an elastically deformable insert, with a central opening having a boundary area which comprises oblique, bevelled restraining lips (6), adapted to exert a "barb-like" contact about a surface of an inserted pen.

3. A stand according to claim 1, characterized in that said restraining element (5) further comprises an elastically deformable insert, with a central opening having a boundary area which comprises oblique, bevelled restraining lips (6), adapted to exert a "barb-like" contact about a surface of an inserted pen.

* * * * *